US006098804A

United States Patent [19]

Bartholomew

[11] Patent Number: 6,098,804

[45] Date of Patent: Aug. 8, 2000

[54] METAL PACKAGING STRUCTURE FOR A BUNDLE OF PANELS

[75] Inventor: David M. Bartholomew, Greensburg, Pa.

[73] Assignee: Menasha Corporation, Neenah, Wis.

[21] Appl. No.: 09/413,071

[22] Filed: Oct. 6, 1999

[51] Int. Cl.[7] ..... B65D 85/48

[52] U.S. Cl. ..... 206/451; 206/453; 206/454; 206/597

[58] Field of Search ..... 206/449, 451, 206/453, 454, 499, 597; 217/66, 68, 69

[56] References Cited

U.S. PATENT DOCUMENTS

| | | | |
|---|---|---|---|
| 1,607,711 | 11/1926 | Walker | 217/69 |
| 1,714,692 | 5/1929 | Pagel et al. . | |
| 1,910,783 | 5/1933 | Way . | |
| 2,015,419 | 9/1935 | Ceely . | |
| 2,197,598 | 4/1940 | Way | 206/451 |
| 2,214,173 | 9/1940 | Nebe | 206/597 |
| 2,262,730 | 11/1941 | Way | 206/451 |
| 2,281,657 | 5/1942 | Aquino . | |
| 2,692,064 | 10/1954 | Koester | 217/68 |
| 2,792,252 | 5/1957 | Ernst | 206/449 |
| 2,792,936 | 5/1957 | Johnson . | |
| 2,885,139 | 5/1959 | Werner et al. | 206/453 |
| 2,905,114 | 9/1959 | Olson . | |
| 3,233,753 | 2/1966 | Rich . | |
| 3,273,706 | 9/1966 | Bundy . | |
| 3,403,777 | 10/1968 | Bucko . | |
| 3,547,457 | 12/1970 | Langer . | |
| 3,618,755 | 11/1971 | Kean et al. . | |
| 3,645,389 | 2/1972 | Castiaux . | |
| 3,713,579 | 1/1973 | Chaffers . | |
| 3,720,035 | 3/1973 | Rutter . | |
| 3,805,473 | 4/1974 | Lidgard . | |
| 3,946,868 | 3/1976 | Rutter | 206/455 |
| 4,019,634 | 4/1977 | Bonnot | 206/386 |
| 4,241,832 | 12/1980 | Bliss | 206/523 |
| 4,467,922 | 8/1984 | Rowley | 206/597 |
| 4,512,473 | 4/1985 | Thomaswick et al. | 206/454 |
| 4,645,122 | 2/1987 | Nederveld | 206/509 |
| 4,960,209 | 10/1990 | Tudor | 206/451 |
| 5,137,165 | 8/1992 | Friman | 206/511 |
| 5,154,297 | 10/1992 | Farley | 206/453 |
| 5,174,448 | 12/1992 | Flaig | 206/451 |
| 5,515,937 | 5/1996 | Sharp | 206/497 |
| 5,803,257 | 9/1998 | Bartholomew | 206/454 |
| 5,813,536 | 9/1998 | Bartholomew | 206/449 |
| 5,909,808 | 6/1999 | Bartholomew | 206/451 |

FOREIGN PATENT DOCUMENTS

| | | |
|---|---|---|
| 0103535 | 3/1984 | European Pat. Off. . |
| 2268712 | 4/1974 | France . |

*Primary Examiner*—Jim Foster

*Attorney, Agent, or Firm*—Quarles & Brady LLP; George E. Haas

[57] ABSTRACT

A package for shipping and storing a bundle of glass panels includes a plurality of elongated corner caps located at corners of the bundle. A plurality of fastening bands extend around the bundle and through the corner caps. The fastening bands pass over curved surfaces on the corner caps which prevent the bands from making sharp bends. Some of the curved surfaces are located on swivel guides with rotate to accommodate different angles of the fastening bands for different size bundles of panels.

15 Claims, 3 Drawing Sheets

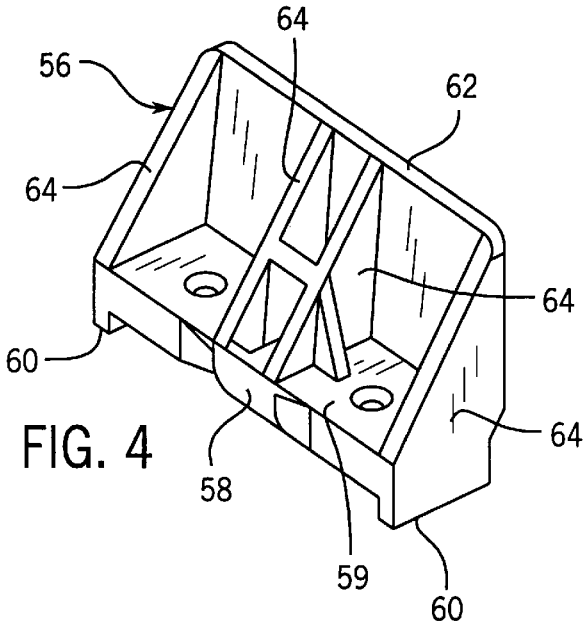
FIG. 4
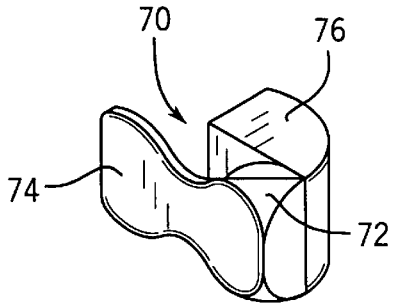
FIG. 5
FIG. 6
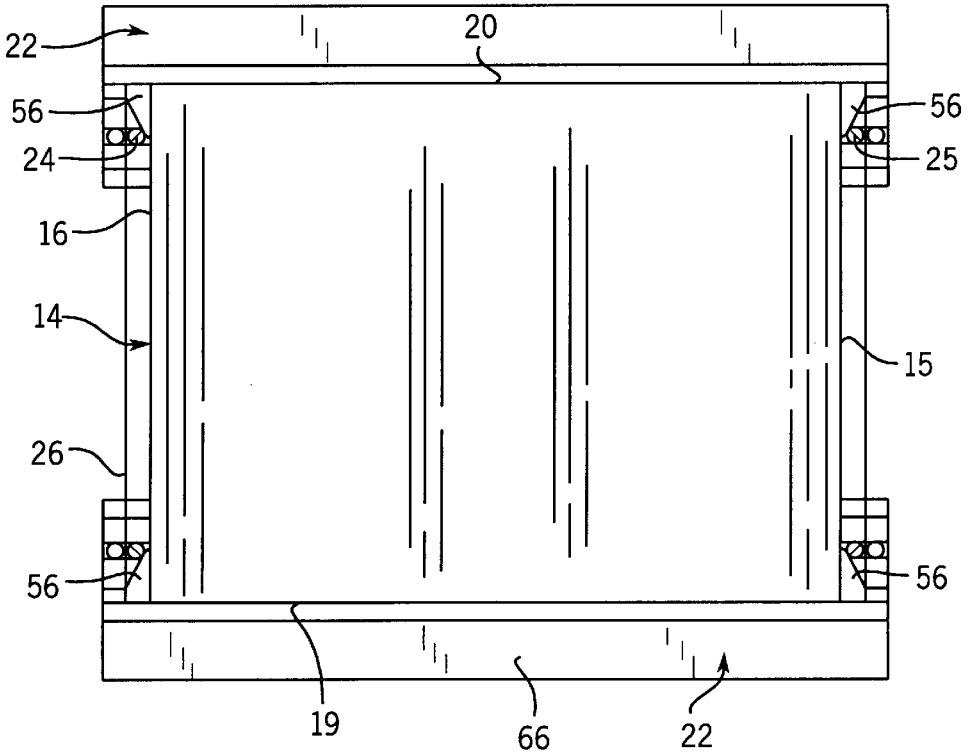

METAL PACKAGING STRUCTURE FOR A BUNDLE OF PANELS

BACKGROUND OF THE INVENTION

The present invention relates to containers for storing and shipping panels, such as panes of glass.

Flat sheets of glass are commonly shipped in a bundle comprising a plurality of sheets of identical rectangular dimensions with a powder between abutting sheets. The bundle often is secured in a steel rack which can be handled by a forklift or similar material handling equipment. The steel racks can be stacked one upon another in a warehouse with the lower racks supporting the weight of the racks above.

Although the steel racks protect the glass during shipment and storage, there are two drawbacks to their use. The racks are not adjustable and are fabricated in a size that is capable of holding the largest glass panel produced by the manufacturer. Thus when smaller panels are shipped and stored, the container takes up a significantly larger volume than is required by the stack of glass panes. In addition the steel racks weight between 300 and 600 pounds which adds significantly to the shipping weight and thus the freight costs. Further, the weight also determines the cost of returning the racks to the manufacturer for reuse.

More recently packaging has been devised which employ four corner caps that extend along the intersection of the edges of the stack of glass panels. Corrugated cardboard or wooden sheets extend between adjacent pairs of the corner caps to prevent the stack from racking. Metal or plastic bands then are placed around the stack to hold the corner caps in place.

Although this corner cap structure was an improvement over the racks previously used, it requires the use of corrugated cardboard or wooden sheets which as cut to the dimensions of the specific bundle of glass panes being shipped. In addition, the bands that wrap around the assembly bend sharply at ninety degrees at each corner cap which makes tightening the bands difficult.

SUMMARY OF THE INVENTION

The present invention provides a protective packaging structure in which to ship and store a bundle of panels, such as glass panes. Each panel has two major surfaces and a plurality of edge surfaces connecting the two major surfaces. The exposed major surfaces of two outermost panels form first and second sides of the bundle and vertically oriented edge surfaces of the panels form third and fourth sides of the bundle.

The packaging structure includes a plurality of corner caps with each one located at a corner of the bundle where two edge surfaces of the panels intersect. Each corner cap has a first member and a second member connected lengthwise at an angle for embracing a corner of the bundle. The first member has a two apertures there through.

First and second strapping bands pass through apertures in every corner cap. Both of the first and second strapping bands have first portions that extend across the first side of the bundle and have second portions that extend across the second side of the bundle. The first and second strapping bands also extend across the third and fourth sides of the bundle at which places the first and second strapping bands cross each other. A third strapping band passes through the corner caps located on corners at the third side of the bundle and a fourth strapping band passes through the corner caps located on corners at the fourth side of the bundle.

In the preferred embodiment, a swivel guide in rotatably located in each aperture of the corner caps. Each swivel guide has a curved surface across which a respective one of the first and second strapping bands lays. Additional curved surfaces are provided on the corner caps which eliminate the third and fourth strapping bands from making sharp bends.

BRIEF DESCRIPTION OF THE DRAWINGS

FIG. 4 is an isometric view of a slide plate which is part of the corner caps;

FIG. 5 is an isometric view of swivel on the corner caps over which fastening bands pass; and FIG. 6 is a cross sectional view along line 5—5 in FIG. 1.

DETAILED DESCRIPTION OF THE INVENTION

Figure 1:
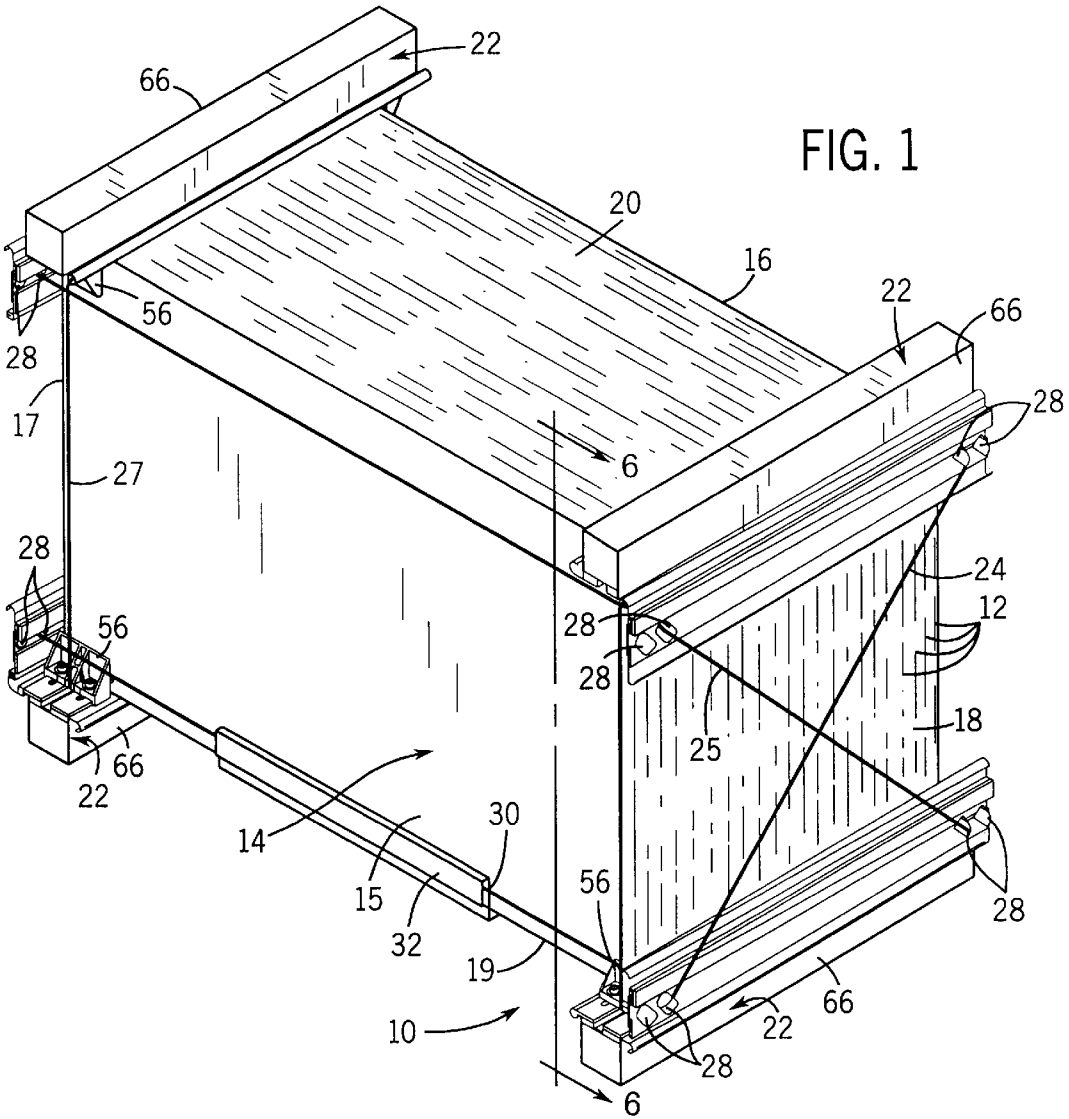
FIG. 1 is an isometric view of a bundle of panels contained within a packaging structure according to the present invention.

With initial reference to FIG. 1, each of a plurality of rectangular glass panels 12 of like size and shape, each one having two major surfaces with four thin edge surfaces extending between the two major surfaces. The glass panels 12 are stacked on edge in a bundle 14 with their major surfaces abutting one another, thus the exposed major surfaces of the two outermost panels form first and second sides 15 and 16 of the bundle 14 and the edge surfaces of the panels form third, fourth, fifth and sixth sides 17, 18, 19, and 20 of the bundle. The opposing third and fourth sides 17 and 18 are formed by the vertical edge surfaces of the panels as placed into the bundle, while the horizontally oriented panel edge surfaces form the bundle's opposite fifth and sixth sides 19 and 20.

A packaging structure, generally designated 10, is utilized to transport the bundle 14 of glass panels 12 oriented vertically. The packaging structure 10 comprises four corner caps 22 held onto the bundle by four fastening bands 24–27. The corner caps 22 extend across edge surfaces of all panels 12 at different corners of the bundle 14 where two edge surfaces of each panel intersect. The corner caps 22 preferably are fabricated of steel and protect the corners of the glass panels from damage. The corner caps 22 project beyond the exposed major surfaces of the outer glass panels 12 in the bundle 14 to offer some degree of protection against objects striking those surfaces. This extension beyond the outer glass panels also spaces the bundles 14 from one another when placed side-by-side during shipment and storage.

The corner caps 22 are held in place on the bundle 14 by four metal or plastic fastening bands 24, 25, 26, and 27 which extend through the corner caps and around the bundle. The ends of the fastening bands 24–27 are secured together by conventional means. The first and second fastening bands 24 and 25 pass through all four corner caps 22. Specifically fastening bands 24 and 25 pass in parallel across the exposed major surfaces of the outermost panels 12 which form the first and second sides 15 and 16 of the bundle 14. The first and second fastening bands 24 and 25 then bend through apertures 28 near the ends of the corner caps 22 and extend diagonally across the vertical third and fourth sides 17 and 18 of the bundle 14 which are formed by the vertical edge surfaces of the panels 12. The diagonal orientation causes the first and second fastening bands 24 and 25 to cross each other and prevents the bundle of panels from racking.

The portions of the first and second fastening bands 24 and 25 that pass along the lower edges of the first and second sides 15 and 16, travel through channels 30 in a lifting tray 32 which extends across the fifth, or bottom, side 19 of the bundle 14. The lifting tray 32, which is raised above the floor on which the bundle rests, allows forks of an industrial lift truck to engage the bundle without damaging the panels 12.

Figure 2:
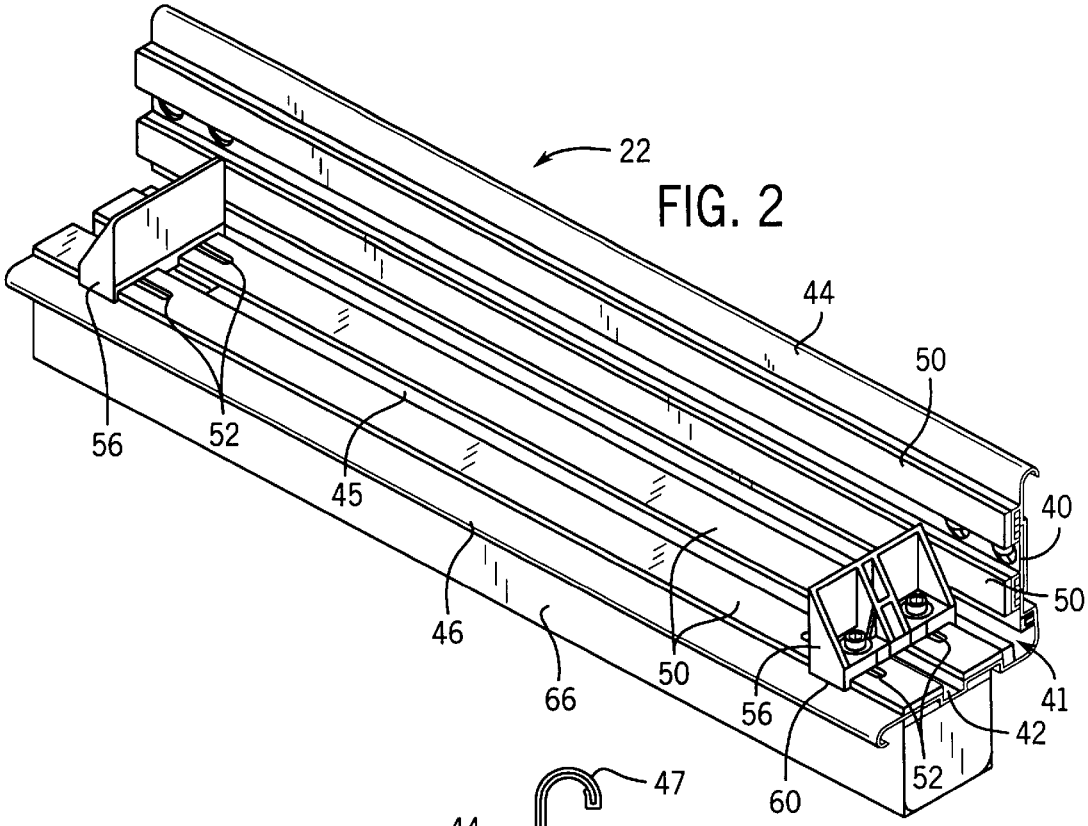
FIG. 2 is an isometric view of a corner cap of the packaging structure.
Figure 3:
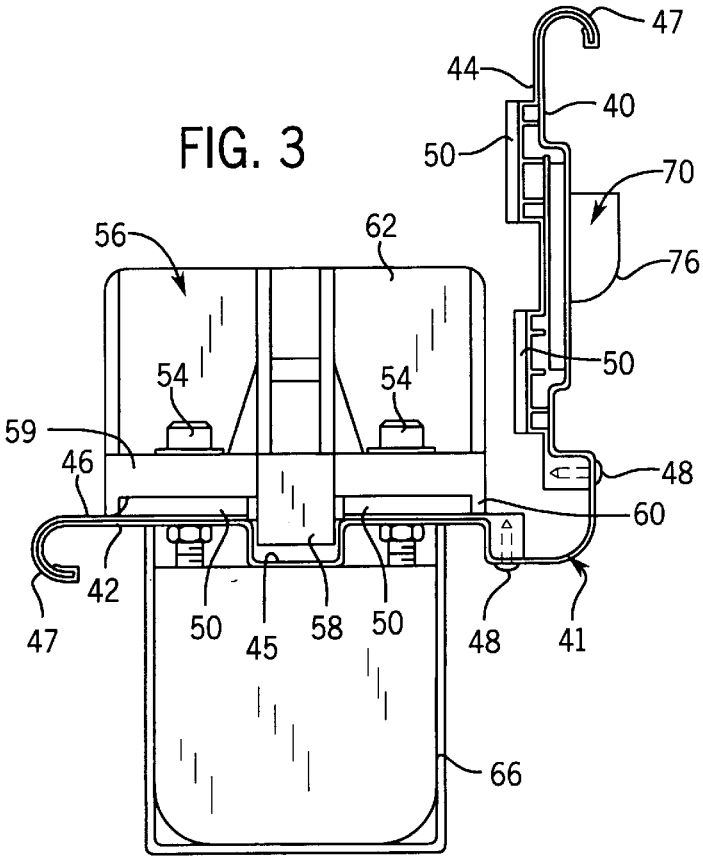
FIG. 3 is an end view of a corner cap.

With reference to FIGS. 2 and 3, each corner cap 22 comprises a steel body 41 with a vertical member 40 and a horizontal member 42 connected lengthwise at a right angle. This forms a corner cap 22 with an L-shaped cross-section having an inside corner for embracing a corner of the panel bundle 14. A pair of plastic covers 44 and 46 are attached to the inside surfaces of the vertical and horizontal members 40 and 42, respectively. Each cover 44 and 46 has a curved edge 47 which conforms to and wraps around a curved edge of the associated corner cap member 40 and 42 to aid in securing the cover in place. The opposite edge of each cover 44 and 46 is attached to the respective vertical and horizontal members 40 and 42 by a series of machine screw 48. Both covers 44 and 46 have a pair of raised tracks that are covered with a relatively soft, resilient plastic strip 50 which engages and cushions the glass panels 12 when the corner cap 22 is placed on the panel bundle 14.

The horizontal member 42 and its mating cover 40 have a pair of slots 52 there through and extending longitudinally along the end cap adjacent to each end. The slots 52 at each end receive shoulder bolts 54 which secure a slide plate 56 to the horizontal member 42. The shoulder bolts 54 permit the slide plate 56 to slide freely along the slots and abut the bundle 14 of panels, as will be described. As visible in FIGS. 3 and 4, each slide plate 56 has a curved tab 58 which projects downward from a base 59 and into a central groove 45 in both the cover 46 and horizontal member 42. This curved tab 58 guides fastening band 27 or 28 when the corner cap 22 is placed on a panel bundle, as will be described. The outer bottom edges of the slide plate 56 have thin tabs 60 which extend along an edge of the plastic strips 50 on the cover 46 to guide movement of the slide plate along the slots 52. Each slide plate 56 has a rectangular wall 62 which projects orthogonally from the base 59 and four triangular buttresses 64 extend between the base and the wall 63.

Referring again to FIGS. 2 and 3, a hollow rectangular channel 66 extends longitudinally along the outer surface of the horizontal corner cap member 46. As evident from FIG. 1, when four corner caps 22 are placed onto a bundle of panels, the rectangular channels 66 on the lower corner caps 22 raise the package from the floor thereby enabling forks of an industrial lift truck to slide there beneath in order to raise and transport the bundle of glass panels. The rectangular channels 66 on the upper corner caps 22 provide surfaces for supporting another bundle of panels above the package without directly contacting the panels 12.

The vertical member 44 of each corner cap 22 has a plurality of circular apertures 28 through which fastening bands 24 and 25 pass to secure the caps to the panel bundle as shown in FIG. 1. With reference to FIGS. 3 and 5, a swivel guide 70 is placed within each of these apertures 28 to direct the respective fastening band. Each swivel guide 70 has a rounded shaft 72 which fits within an aperture 28 and a flat tab 74 on one end of the rounded shaft 72 holds the guide in the aperture. A curved head 76 is at the other end of the rounded shaft 72. The swivel guide 70 is able to rotate freely within the corresponding corner cap aperture 28 without falling out.

When the corner caps 22 are placed onto corners of the glass panel bundle 14 as shown in FIG. 1, the bundle is centrally positioned along the length of each corner cap. The third fastening band 26 then is placed through the pair of corner caps 22 at one end of the bundle. In doing so the third fastening band 26 is threaded around the slide plates 56 and through the grooves 45 in the horizontal members 46 of the two corner caps 22. This fastening band 26 passes over the curved tab 58 on each slide plate which prevent the band from making a sharp bend which could weaken its strength. In addition the curved tab 58 enables the fastening band to be easily tightened. Such tightening of the third fastening band 26 draws the slide plates 56 snugly against the panel bundle 14, as seen in FIG. 6, which holds the individual panels 12 together in a tight bundle. The ends of the fastening bands 24–27 are secured together by conventional means. The pair of slide plates 56 on each corner cap 22 allows the packaging structure 10 to accommodate panel bundles 14 of different sizes. The fourth fastening band 27 is attached in the same manner to the corner caps 22 at the opposite end of the glass panel bundle 14.

Next, the first and second fastening bands 24 and 25 then are threaded through the corner caps as shown in FIG. 1 and described previously. As the two fastening bands 24 and 25 go through the apertures in the corner caps 22, they pass over the curved head 76 of each swivel guide 70. This prevents the fastening bands from making sharp bends at each aperture and facilitates tighten the bands. It should be noted that the angles at which the first and second fastening bands 24 and 25 pass through the apertures varies depending upon the width of the panel bundle 14, which in-turn depends on the number and thickness of bundled panels 12. Because the swivel guides 70 are able to rotate with the apertures 28, their curved heads 76 automatically align with the surface of the fastening band 24 or 25 regardless of the angle at which the fastening bands pass through the apertures.

Several packaging structures 10 can be stacked one on top of another in a warehouse because the glass panels 12 are stacked on edge in the bundle 14. The corner caps 22 distribute the weight of the higher bundles across the edge surfaces of all the panels in the bundle to which the caps are attached. This on-edge orientation takes advantage of the compressive strength of the glass panels which enables the lower bundles to support the load of the bundles above without breaking.

The present packaging structure 10 provides a low cost packaging mechanism for safely shipping and storing panels such as glass panes, doors and sheet goods. In addition this packaging structure offers significant weight reduction over steel racks previously used to ship and store glass panels.

I claim:

1. A packaging structure for a bundle of panels in which each panel has two major surfaces and a plurality of edge surfaces connecting the two major surfaces, wherein exposed major surfaces of two outermost panels in the bundle form first and second sides of the bundle and vertically oriented edge surfaces of the panels form third and fourth sides of the bundle, said packaging structure comprising:

a plurality of corner caps with each one located at a corner of the bundle where two edge surfaces of the panels intersect, and each corner cap has a first member and a second member connected lengthwise at an angle for embracing one corner of the bundle, each of the plurality of corner caps having a two apertures there through;

first and second fastening bands pass through all of the plurality of corner caps, the first and second fastening bands have first portions extending across the first side of the bundle and have second portions extending across the second side of the bundle, and the first and second fastening bands cross each other as the first and second fastening bands extend across the third and fourth side of the bundle;

a third fastening band which passes through those of the plurality of corner caps located on corners of the bundle at the third side of the bundle; and a fourth fastening band which passes through those of the plurality of corner caps located on corners of the bundle at the fourth side of the bundle.

2. The packaging structure as recited in claim 1 wherein the first portions of the first and second fastening bands extend parallel to each other, and the second portions of the first and second fastening bands extend parallel to each other.

3. The packaging structure as recited in claim 1 wherein each of the plurality of corner caps further comprises a pair of slide plates moveably mounted thereon to retain the bundle there between.

4. The packaging structure as recited in claim 3 wherein each of the pair of slide plates has a curved surface over which a respective one of the third fastening band and the fourth fastening band passes.

5. The packaging structure as recited in claim 1 wherein each of the plurality of corner caps further has a groove with a respective one of the third fastening band and the fourth fastening band received in the groove.

6. The packaging structure as recited in claim 1 wherein each of the plurality of corner caps further comprises a separate swivel guide rotatably received in each of the two apertures.

7. The packaging structure as recited in claim 6 wherein each swivel guide has a curved surface over which a respective one of the first fastening band and the second fastening band passes.

8. A packaging structure for a bundle of panels in which each panel has two major surfaces and a plurality of edge surfaces extending between the two major surfaces, wherein exposed major surfaces of two outermost panels in the bundle form first and second sides of the bundle, vertically oriented edge surfaces of the panels form third and fourth sides of the bundle, and horizontally oriented edge surfaces of the panels form fifth and sixth sides of the bundle, said packaging structure comprising:

first, second, third and fourth corner caps with each one located at a corner of the bundle where two edge surfaces of the panels intersect, and each corner cap has a first member and a second member connected lengthwise at an angle for embracing one corner of the bundle, the first member having a two apertures there through;

first and second fastening bands pass through every one of the first, second, third and fourth corner caps, the first and second fastening bands have first portions extending across to the first side of the bundle parallel to the fifth and sixth sides and have second portions extending across to the second side of the bundle parallel to the fifth and sixth sides, and the first and second fastening bands cross each other as the first and second fastening bands extend across the third and fourth sides of the bundle;

a third fastening band passing through the first and second corner caps located at corners at the third side of the bundle; and a fourth fastening band which passes through the third and fourth corner caps located at corners at the fourth side of the bundle.

9. The packaging structure as recited in claim 8 wherein each of the first, second, third and fourth corner caps further comprises a pair of slide plates are slidably mounted on the second member to retain the bundle there between.

10. The packaging structure as recited in claim 9 wherein each of the pair of slide plates has a curved surface over which a respective one of the third fastening band and the fourth fastening band passes.

11. The packaging structure as recited in claim 8 wherein each of the first, second, third and fourth corner caps further has a groove in the second member with a respective one of the third fastening band and the fourth fastening band received in the groove.

12. The packaging structure as recited in claim 8 wherein each of the first, second, third and fourth corner caps further comprises a separate swivel guide rotatably received in the two apertures in the first member.

13. The packaging structure as recited in claim 12 wherein each swivel guide has a curved surface over which a respective one of the first fastening band and the second fastening band passes.

14. A packaging structure for a bundle of panels in which each panel has two major surfaces and a plurality of edge surfaces connecting the two major surfaces, wherein exposed major surfaces of two outermost panels in the bundle form first and second sides of the bundle and vertically oriented edge surfaces of the panels form third and fourth sides of the bundle, and horizontally oriented edge surfaces of the panels form fifth and sixth sides of the bundle, said packaging structure comprising:

a plurality of corner caps with each one located at a corner of the bundle where two edge surfaces of the panels intersect, and each corner cap has a first member and a second member connected lengthwise at an angle for embracing one corner of the bundle, the first member having a two apertures and a separate swivel guide rotatably received in each aperture and having a curved surface, and the second member has pair of slide plates slidably mounted thereon to retain the bundle there between, each slide plate having a curved surface;

first and second fastening bands pass through the apertures in all of the plurality of corner caps and engage the curved surface of each swivel guide, the first and second fastening bands cross each other as they extend across the third and fourth side of the bundle;

a third fastening band which passes through those of the plurality of corner caps located on corners of the bundle at the third side of the bundle; and a fourth fastening band which passes through those of the plurality of corner caps located on corners of the bundle at the fourth side of the bundle.

15. The packaging structure as recited in claim 14 wherein each of the plurality of corner caps further has a groove in the second member with a respective one of the third fastening band and the fourth fastening band received in the groove.

* * * * *